United States Patent [19]

Sakai et al.

[11] Patent Number: 4,903,505

[45] Date of Patent: Feb. 27, 1990

[54] AUTOMATIC ICE MANUFACTURING APPARATUS

[75] Inventors: Tadashi Sakai; Hideji Ohta, both of Toyoake, Japan

[73] Assignee: Hoshizaki Electric Co., Ltd., Toyoake, Japan

[21] Appl. No.: 304,370

[22] Filed: Jan. 30, 1989

[51] Int. Cl.[4] ..... F25C 1/12

[52] U.S. Cl. ..... 62/347; 417/299

[58] Field of Search ..... 62/347; 417/299, 302

[56] References Cited

U.S. PATENT DOCUMENTS

| | | | |
|---|---|---|---|
| 2,806,357 | 9/1957 | Pichler | 62/347 X |
| 4,249,558 | 2/1981 | Clifford et al. | 417/299 X |
| 4,483,667 | 11/1984 | Berges et al. | 417/299 X |
| 4,525,129 | 6/1985 | Berges et al. | 417/299 X |
| 4,785,641 | 11/1988 | McDougal | 62/347 X |

*Primary Examiner*—William E. Tapolcai

*Attorney, Agent, or Firm*—Brooks Haidt Haffner & Delahunty

[57] ABSTRACT

An automatic ice manufacturing apparatus comprises an ice making unit for manufacturing ice in an icing operation cycle, a water tank disposed below the ice making unit for storing water to undergo phase transformation into ice on the ice making unit, a first water spray tube disposed above the ice making unit for spraying the water onto the ice making unit, a water circulating conduit interconnecting the first water spray tube and the water tank, a circulating pump mounted in the circulating conduit for circulating the water between the water tank and the ice making unit, and an overflow pipe disposed within the water tank for controlling the highest water level within the water tank. A branch pipe branched from the circulating conduit on the discharge side of the circulating pump and having an open end portion positioned above and in the vicinity of the overflow pipe so that by lowering a discharge pressure of the circulating pump at the start of a deicing operation cycle, water remaining within the water tank at the end of the icing operation cycle is discharged from the open end of the branch pipe into the overflow pipe to be thereby drained from the apparatus. A valve for opening and closing the branch pipe can be provided. Impurity concentration of water for forming ice can be prevented from increasing. Improved ice making performance and high quality of manufactured ice can be ensured.

9 Claims, 3 Drawing Sheets

AUTOMATIC ICE MANUFACTURING APPARATUS

BACKGROUND OF THE INVENTION

1. Field of the Invention

The present invention generally relates to an automatic ice making or manufacturing apparatus, and more particularly to an automatic ice manufacturing apparatus having a structure capable of suppressing increase in the concentration of impurities contained in ice making water (i.e. raw water to be iced) stored in a raw water tank.

2. Description of the Prior Art

Referring to FIG. 3, there is schematically shown a typical structure of the automatic ice manufacturing machine known heretofore in the art, wherein a reference numeral 1 denotes an ice making unit which is composed of an ice forming plate 2 and an evaporator tube 3 mounted on the rear surface of the ice forming plate 2 in a meandering pattern. Disposed above the ice making unit 1 is a first water spray or distribution tube 4 which is provided with an array of water spray orifices 4*a* for distributing water over the front surface of the ice forming plate 2, which water then flows downwardly over and along the plate 2. The first water spray tube 4 is connected to a water tank 6 storing raw water (i.e. water used for making ice) by way of a water circulating conduit 5 in which a circulating pump 7 is provided for circulating water between the water tank 6 and the ice making unit 1 through the circulating conduit 5.

Further disposed above the ice making unit 1 is a second water spray tube 8 having formed therein a row of plural water spray orifices 8*a* for spraying water onto the rear surface of the ice forming plate 2, the water as sprayed flowing therealong downwardly under gravity. This second water spray tube 8 is connected to a raw water supply source (not shown) through a water supply pipe 9 which is equipped at an intermediate portion thereof with a water valve 10 adapted to be opened during a deicing (ice removing) cycle for supplying water to be sprayed over the rear surface of the ice forming plate 2.

Installed between the ice making unit 1 and the water tank 6 is an inclined ice guide plate 11, in which a plurality of dewatering holes 11*a* are formed. An overflow pipe 12 upstanding vertically is fixedly mounted on the bottom of the water tank 6, extending therethrough downwardly, and serves for controlling the highest water level within the water tank 6. A sub-tank 14 having a float switch 13 mounted therein is hydraulically communicated with the water tank 6.

Operation of the automatic ice manufacturing machine of the above structure described will be explained. During an ice making cycle (also referred to as the icing cycle), a refrigerating system (not shown) is operated to supply a coolant of low temperature and low pressure to the evaporator tube 3, whereby the ice forming plate 2 is cooled down. Additionally, the water circulating pump 7 is operated to circulate water between the ice forming plate 2 and the water tank 6. Water is refrigerated in the course of flowing downwardly along and over the front surface of the ice forming plate 2, resulting in that ice grows progressively on the plate 2, which is accompanied with corresponding lowering of the water level within the tank 6. When the ice has grown to a predetermined thickness on the ice forming plate 2 with the water level within the tank 6 also having been lowered to a predetermined level, the float switch 13 detects this level and produces a corresponding output signal which is applied to a control apparatus (not shown), whereby the operation of the water circulating pump 7 is stopped while the water valve 10 is opened under the command of the control apparatus. Thus, the icing operation cycle comes to the end, being followed by the start of an ice removing cycle (also referred to as the deicing operation cycle).

When the water valve 10 is opened at the start of the deicing operation cycle, raw water supplied through the pipe 9 from the water source (not shown) is sprayed over the rear surface of the ice forming plate 2 from the second water spray tube 8 and flows downwardly to be stored within the water tank 6 through the dewatering holes 11*a*. During the flowing of water along the rear surface of the ice forming plate 2, ice formed thereon is partially defrozen at a portion contacting the ice forming plate 2 after lapse of a time due to the heat exchange between the water and a medium of a high pressure and a high temperature which is caused to flow through the evaporator tube 3 simultaneousy with the opening if the water valve 10. Ice is thus removed from the ice forming plate 2 and drops onto the inclined guide plate 11 to be ultimately stored in an ice storing chamber (not shown). In the course of the deicing cycle, the water level within the tank 6 reaches the open upper end 12*a* of the overflow pipe 12. Thereafter, water flowing into the tank 6 is drained outwardly through the overflow pipe 12.

In succession to the removal of ice from the ice forming plate 2, the temperature of the evaporator tube 3 increases to a predetermined point, which is detected by a deicing temperature sensor (not shown) mounted on the evaporator tube 3. In response to the output signal of the sensor, the water valve 10 is closed, while the operation of the water circulating pump 7 is restarted with the coolant of low temperature and low pressure being again fed through the evaporator tube 3. In other words, the deicing cycle is completed and the icing cycle described previously is initiated again.

In the automatic ice manufacturing machine of the structure described above, it is observed that repetition of the icing cycle brings about progressive increase in the concentration of impurities contained in raw water the water tank 6. In case the impurity concentration of raw water supplied through the pipe 9 is high, sediments such as calcium and other will be deposited on the bottom of the water tank 6, and sometimes the water spray orifices 4*a* of the first spray tube 4 are blocked or closed, presenting an obstacle to the normal icing operation and/or involving deterioration in the quality of ice as manufactured.

SUMMARY OF THE INVENTION

In the light of the problems of the prior art automatic ice manufacturing machine described above, it is an object of the present invention to provide an automatic ice manufacturing apparatus which is capable of suppressing increase in the impurity concentration of raw water within the water tank to thereby mitigate or prevent sedimentation of the impurities on the tank bottom and hence attendant degradation of the ice manufacturing capability of the apparatus as well as deterioration in the quality of ice as manufactured.

In view of the above object, it is proposed according to a first aspect of the present invention to provide a branch pipe on the discharge side of the water circulating pump in such a disposition that the open free end of the branch pipe is located above and in the vicinity of the overflow pipe, serving as a drainage pipe, so that raw water can be discharged through the branch tube and the overflow pipe by lowering the discharge pressure or pumping-up capability of the circulating pump during the deicing operation cycle.

In the automatic ice making apparatus of the structure mentioned above, the pumping-up capability of the circulating pump is lowered at the time the deicing cycle is started, to thereby allow water of the high impurity concentration remaining within the raw water tank at the end of the icing operation cycle to be discharged from the open free end of the branch conduit into the overflow pipe to be discharged outside of the apparatus.

Further, for achieving the abovementioned object of the present invention, there is provided according to a second aspect of the invention an automatic ice manufacturing apparatus which includes a branch pipe branched from the circulating conduit on the discharge side of the circulating pump and a pressure-actuated valve disposed within the branched pipe for closing the flow path thereof when the discharge pressure of the circulating pump is high while opening the water flow path defined by the branched pipe when the discharge pressure of the circulating pump is low.

In the automatic ice manufacturing apparatus of the structure mentioned above, the discharge pressure of the circulating pump is lowered upon starting of the deicing operation cycle to open the pressure-actuated valve for thereby allowing the icing water of a relatively high impurity concentration remaining within the water tank at the end of the icing cycle to be drained externally of the apparatus through the branched pipe and the overflow pipe.

BRIEF DESCRIPTION OF THE DRAWINGS

Above and other objects, features and advantages of the present invention will be more apparent from the following description taken in conjunction with the preferred embodiments of the invention, given by way of example only, by reference to the accompanying drawings, in which.

DESCRIPTION OF THE PREFERRED EMBODIMENTS

Now, the present invention will be described in detail in conjunction with the exemplary and preferred embodiments thereof by reference to the accompanying drawings.

Figure 1:
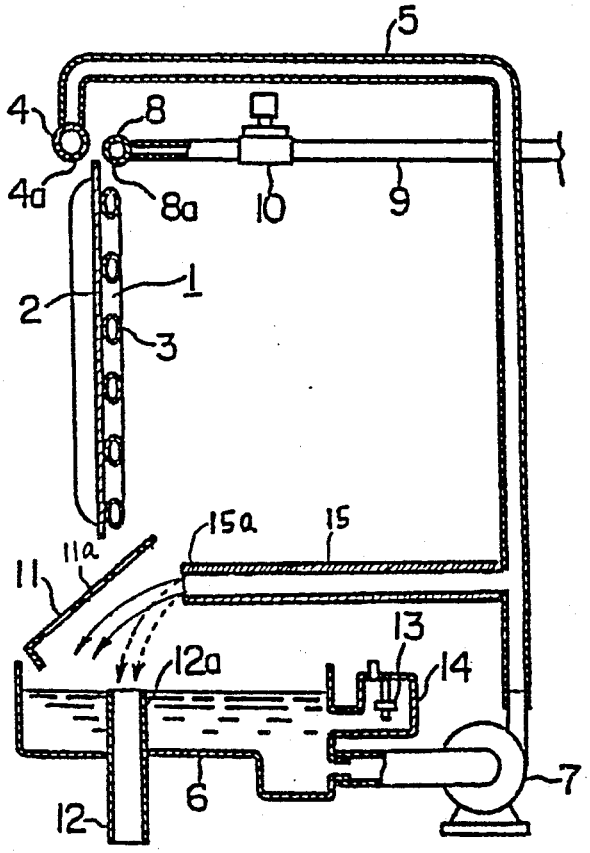
FIG. 1 is a side elevational view schematically showing, partially in section, a general arrangement of an automatic ice manufacturing apparatus according to a first embodiment of the present invention.
Figure 3:
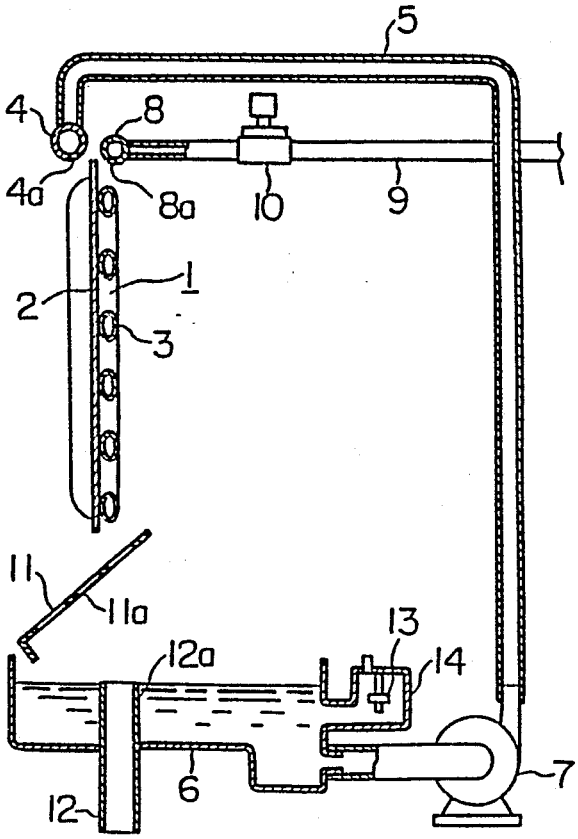
Fig. 3. PRIOR ART
FIG. 3 is a schematic side elevational view showing a structure of the automatic ice manufacturing machine known heretofore.

FIG. 1 shows an automatic ice manufacturing apparatus according to a first embodiment of the invention. In this figure, equivalent or same parts as those shown in FIG. 3 are denoted by like reference symbols and repeated description thereof will be omitted.

As can clearly be seen in FIG. 1, a branched pipe 15 extends from the water circulating conduit 5 on the discharge side of the circulating pump 7 in such a disposition that the open free end 15*a* of the pipe 15 is located above and in the vicinity of the overflow pipe 12. Except for this structure, the automatic ice manufacturing apparatus shown in FIG. 1 is substantially identical with the one shown in FIG. 3.

During the icing operation cycle of the automatic ice manufacturing apparatus of the structure described above, water is refrigerated on the ice forming plate 2. As the ice grows progressively on the plate 2, the water level within the tank 6 is progressively lowered. When the ice has grown to a predetermined thickness with the water level within the tank 6 being lowered to a predetermined level, this is detected by the float switch 13, whereupon the icing operation cycle comes to the end under control of a control apparatus (not shown).

During the deicing operation cycle, the circulating pump 7 is continuously operated in the state in which the pumping-up (discharging) capability is lowered by the control apparatus (not shown) in response to the signal produced by the float switch 13. As a control method for lowering the pumping-up capability of the circulating pump 7, there may be adopted various control measures such as lowering of voltage applied to a drive motor for the pump 7, phase control of the motor, lowering of operative capacity of a condenser motor when it is employed as the drive motor, frequency control of the electric power supplied to the pump motor, changing over of the power supply to the condenser motor selectively between two windings referred to as the normal winding and the auxiliary winding or the like. The control of this sort can be realized by a control apparatus (not shown) which can easily be designed by those skilled in the art.

By lowering the pumping-up capability of the water circulating pump 7 in the deicing operation cycle in this manner, water remaining within the tank 6 at the end of the icing operation cycle and having a high impurity concentration can not reach the height of the first spray tube 4 by way of the circulating conduit 5 but will be discharged from the open free end 15*a* of the branch pipe 15 into the overflow pipe 12 to be discharged exteriorly of the apparatus.

During the deicing operation cycle, the medium of a high temperature and a high pressure flows through the evaporator tube 3, whereby ice formed on the plate 2 is partially defrozen in the portion contacting the ice forming plate 2 due to heat exchange with the medium. Subsequently, after a period during which water of high impurity concentration in the tank 6 is discharged through the branch pipe 15 and the overflow pipe 12, operation of the circulating pump 7 is stopped, whereupon the water valve 10 is opened, resulting in that the water valve 10 is opened to allow raw water from the water supply pipe 9 to be sprayed from the second water spray tube 8 onto the rear surface of the ice forming plate 2. Thus, raw water is stored in the water tank 6 through the dewatering openings 11*a*. After the water level within the tank has reached the top open end 12*a* of the overflow pipe 12, water is discharged externally of the apparatus through the overflow pipe 12.

As will be appreciated from the above description, the automatic ice manufacturing apparatus according to the first embodiment of the invention is implemented in such a structure in which the pipe 15 is branched from the circulating conduit 5 on the discharged side of the circulating pump 7 and the open free end 15*a* of the pipe 15 is positioned above and in the vicinity of the overflow pipe 12 so that when the pumping-up capability of the circulating pump 7 is lowered at the start of the deicing operation cycle, raw water remaining within the tank 6 at the end of the icing operation cycle is drained externally of the apparatus through the overflow pipe 12, as indicated by broken line arrows. With this structure, it is possible to suppress the impurity content of raw water within the tank 6 to a minimum concentration. Consequently, sedimentation of the impurities on the bottom of the water tank 6 can scarcely occur, whereby degradation of the ice manufacturing capability of the apparatus due to blockage of the water spray orifices 4*a* of the first spray tube 4 as well as deterioration in the ice quality due to high impurity concentration can be mitigated or prevented satisfactorily.

Figure 2:
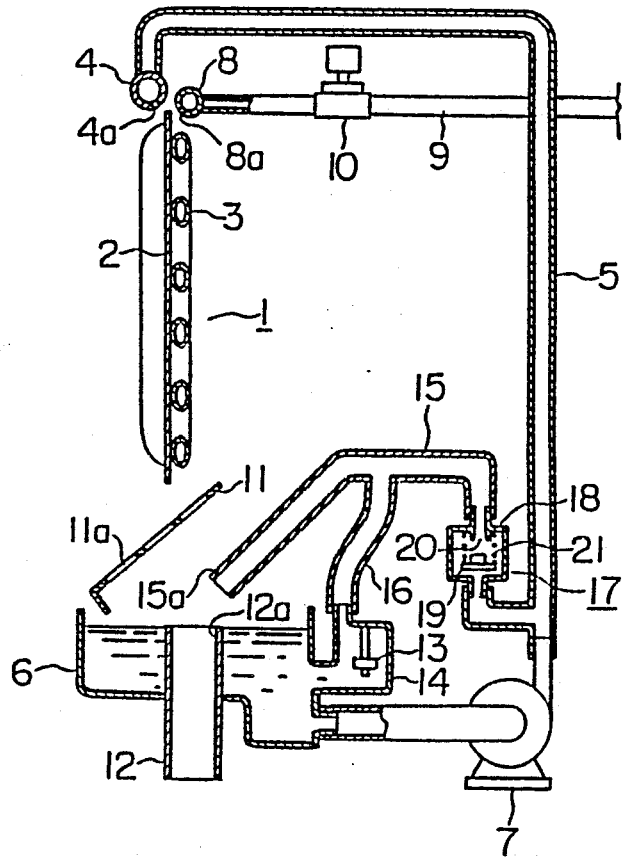
FIG. 2 is a view similar to FIG. 1 and shows a second embodiment of the automatic ice manufacturing apparatus according to the invention.

FIG. 2 shows an ice manufacturing apparatus according to the second embodiment of the present invention. In this figure, parts or components same as or equivalent to those shown in FIGS. 1 and 3 are denoted by like reference symbols and repeated description is omitted.

Referring to FIG. 2, a pipe 15 is branched from the water circulating conduit 5 on the discharge side of the circulating pump 7. This branch pipe 15 has an open free end portion 15*a* directed to the opening 12*a* of the overflow pipe 12 serving for draining water externally of the apparatus. A sub-tank water supply pipe 16 is branched from the main branch pipe 15 at an intermediate portion thereof.

Mounted within the branch pipe 15 at a position upstream of the sub-branch pipe 16 leading to the sub-tank 14 is a pressure-actuated valve 17 which is so implemented as to close the water flow path defined by the branch pipe 15 as long as the discharge pressure of the circulating pump 7 is high while opening the water flow path in response to a low discharge pressure of the circulating pump 7. To this end, the pressure-actuated valve 17 may be composed of a case 18, a valve element 19 formed from a rubber or the like material and disposed movable in the vertical direction, and a spring 21 for resiliently urging the valve element 19 to the position to open a valve exit port 20 against the discharge pressure of the circulating pump 7.

Now, during the icing operation cycle, raw water is caused to circulate between the water tank 6 and the ice making unit 1 to be refrigerated on the ice forming plate 2 in the course of circulation, whereby ice grows progressively on the ice forming plate 2. In this icing operation cycle, the discharge pressure of the circulating pump 7 is maintained high. Consequently, the valve port 20 is closed by the valve element 19 under the hydraulic pressure of water against the repulsion force of the spring 21. Thus, no flow of water takes place through the main branch pipe 15 and the sub-branch pipe 16 during the icing operation cycle. As the ice grows on the ice forming plate 2, the water level within the tank 6 is correspondingly lowered. When the ice has grown to a predetermined thickness, being accompanied by the lowering of the water level within the tank 6 to a predetermined value, the float switch 13 detects this level and produces an output signal. In response to this signal, a control apparatus (not shown) terminates the icing operation cycle.

In the deicing operation cycle triggered in response to the signal produced by the float switch 13, the circulating pump 7 continues to operate in the state in which the discharge pressure thereof is lowered. As a method of lowering the discharge pressure of the circulating pump 7, there may be adopted various control measures such as lowering of voltage applied to a drive motor for the pump 7, phase control of the motor, lowering of capacity of a condenser motor when it is employed as the drive motor, frequency control of the electric power supplied to the pump motor, changing over of the power supply to the condenser motor selectively between two windings referred to as the normal winding and the auxiliary winding or the like. The control of this sort can be realized by a control apparatus (not shown) which can easily be designed by those skilled in the art.

When the discharge pressure of the circulating pump 7 is lowered in this manner, the repulsion force of the spring 21 overcomes the hydraulic pressure exerted by the output of the circulating pump 7, resulting in that the outlet port 20 of the valve 17 is opened to allow water to flow through the branch pipe 15. As the consequence, raw water of a relatively high concentration remaining within the water tank 6 at the end of the icing operation cycle is discharged from the open free end 15*a* of the branch pipe 15 into the overflow pipe 12 to be drained externally of the apparatus. Further, a part of water flows through the second branch pipe 16 to be supplied to the sub-tank 14, whereby impurities accumulated at a high concentration within the sub-tank 14 because of being pushed therein from the tank 6 under the action of water sprayed from the first water spray tube 4 during the icing operation cycle is driven out into the water tank 6.

During the deicing operation cycle, the medium of a high temperature and a high pressure flows through the evaporator tube 3, whereby ice formed on the plate 2 is partially defrozen at the portion contacting the ice forming plate 2 due to heat exchange with the medium. Subsequently, after of a period during which water of high impurity concentration within the tank 6 is discharged through the branch pipe 15 and the overflow pipe 12, operation of the circulating pump 7 is stopped, whereupon the water valve 10 is opened to allow raw water supplied through the water supply pipe 9 to be sprayed from the second water spray tube 8 onto the rear surface of the ice forming plate 2. Thus, water is stored in the water tank 6 through the dewatering openings 11*a*. After the water level has reached the top open end 12*a* of the overflow pipe 12, water is drained externally of the apparatus through the overflow pipe 12.

During the flowing of water along the rear surface of the ice forming plate 2, being sprayed from the second spray tube 8, ice formed thereon is partially defrozen at a portion contacting the ice forming plate 2 after the lapse of a time from the end of the icing cycle due to the heat exchange between the water and the medium of a high pressure and a high temperature which is caused to flow through the evaporator tube 3 simultaneously with the end of the icing operation cycle. Ice is thus removed from the ice forming plate 2 and drops onto the inclined ice guide plate 11 to be ultimately stored in an ice storing chamber (not shown).

After the removal of ice from the ice forming plate 2, the temperature of the evaporator tube 3 is increased to a predetermined point, which is detected by a deicing temperature sensor (not shown) mounted on the evaporator tube 3. In response to the output signal of the sensor, the water valve 10 is closed, while the water circulating pump 7 resumes the high discharge pressure state with the coolant of a low temperature and a low pressure being again fed through the evaporator tube 3. Thus, the deicing cycle is completed and the icing cycle described previously is initiated again.

In the automatic ice manufacturing apparatus described above, water flowing downwardly along the rear surface of the ice forming plate 2 during the deicing cycle is stored within the water tank 6. It should however be noted that the present invention can equally be applied to the automatic ice manufacturing apparatus in which raw water is directedly supplied to the water tank 6. Further, although it has been described that the drainage pipe is constituted by the overflow pipe 12, the invention is not restricted to such structure. The branch pipe 15 may be directly connected to a drainage pipe (not shown).

As will be understood from the above description, the automatic ice manufacturing apparatus according to the second embodiment of the present invention is implemeted in such a structure which includes the branch pipe 15 led out from the water circulating conduit 5 on the discharge side of the circulating pump 7 and the pressure-actuated valve 17 designed and disposed to close the water flow path through the branch pipe 15 when the discharge pressure of the circulating pump 1 is high while opening the branch pipe 15 in response to a low discharge pressure of the pump 7, wherein the discharge pressure of the circulating pump 7 is lowered at the start of the deicing operation cycle to thereby allow raw water of high impurity concentration remaining within the water tank at the end of the icing operation tank to be drained externally of the apparatus through the branch conduit and the drainage pipe. With this structure, it is possible to suppress the concentration of impurities contained in raw water within the tank 6 can be suppressed to a minimum. Consequently, sedimentation of impurities on the tank bottom can scarcely take place, whereby degradation in the ice manufacturing capability due to blockage of the spray orifices 4*a* of the first water spray tube 4 because of sedimentation of impurities as well as deterioration in the ice quality due to high impurity concentration can satisfactorily be prevented or mitigated.

In the automatic ice manufacturing apparatus in which the float switch 13 disposed within the sub-tank 14 is employed in conjunction with the water level control of the water tank 6 and in which the sub-tank water supply pipe 16 is branched from the main branch pipe 15 and has the open end portion connected to the sub-tank 14, water of high impurity concentration which tends to be resident within the sub-tank 14 can be expelled into the tank 6 during the deicing operation cycle, whereby the float switch 13 can be protected against malfunction due to the impurities.

In the foregoing, the present invention has been described in connection with the preferred embodiments only for the illustrative purpose. It should however be appreciated that many modifications, combination and equivalents can readily to occur to those skilled in the art without departing from the spirit and scope of the invention.

What is claimed is:

1. An automatic ice manufacturing machine, comprising:

an ice making unit for manufacturing ice during an icing operation cycle;

a water tank disposed below said ice making unit for storing water to undergo phase transformation into ice on said ice making unit;

a first water spray tube disposed above said ice making unit for spraying said water onto said ice making unit;

a water circulating conduit interconnecting said first water spray tube and said water tank;

a circulating pump provided in said circulating conduit for circulating said water between said water tank and said ice making unit under a first discharge pressure;

a drain pipe having opposite upper and lower open ends coupled to said water tank for draining water from said water tank to an external point;

a branch pipe branched from said water circulating conduit on the discharge side of said circulating pump and having an open end portion so positioned above and in the vicinity of said upper end of said drain pipe that, for a predetermined discharge pressure from said circulating pump lower than said first discharge pressure, water is discharged from said open end portion of said branch pipe into said upper end of said drain pipe to be discharged externally; and means for lowering the discharge pressure of said circulating pump to said predetermined lower discharge pressure at the start of a deicing operation cycle to thereby discharge externally water remaining within said water tank at the end of an icing operation cycle.

2. An apparatus according to claim 1, wherein the water for forming ice is supplied from a second water spray tube connected to a water supply source for spraying water onto said ice making unit for harvesting ice formed thereon during the deicing operation cycle, the water being then accumulated within said water tank.

3. An apparatus according to claim 1, further including a water level detecting switch for detecting a predetermined water level within said water tank, wherein a signal outputted from said switch is utilized for changing over said icing operation cycle and said deicing operation cycle to each other.

4. An apparatus according to claim 1, wherein said drain pipe is an overflow pipe disposed within said water tank for controlling the highest water level within said water tank.

5. An automatic manufacturing apparatus, comprising:

an ice making unit for manufacturing ice in an icing operation cycle;

a water tank disposed below said ice making unit for storing water to undergo phase transformation into ice on said ice making unit;

a first water spray tube disposed above said ice making unit for spraying said water onto said ice making unit;

a water circulating conduit interconnecting said first water spray tube and said water tank;

a circulating pump provided in said water circulating conduit for circulating said water between said water tank and said ice making unit;

a drainage pipe disposed within said water tank for draining water from said water tank externally of the apparatus;

a branch pipe branched from said circulating conduit on the discharge side of said circulating pump for discharging said water through said drainage pipe;

a pressure-actuated valve mounted in said branch pipe for closing a water flow path defined therein when the discharge pressure of said circulating pump is high while opening said flow path when the discharge pressure of said circulating pump is low; and means for lowering said discharge pressure of said circulating pump at the start of a deicing operation cycle to thereby allow the water remaining within said water tank at the end of the icing operation cycle to be drained externally of the apparatus through said branch pipe and said drainage pipe.

6. An apparatus according to claim 5, wherein said drainage pipe is constituted by an overflow pipe mounted within said water tank, extending downwardly through a bottom wall thereof, for controlling the highest water level within said water tank, said branch pipe having an open end disposed in the vicinity of said overflow pipe so that water is discharged from said branch pipe into said overflow pipe when the discharge pressure of said circulating pump is lowered.

7. An apparatus according to claim 5, wherein said water for forming ice is supplied from a second water spray tube connected to a water supply source for spraying water onto said ice making unit for detaching ice formed thereon during said deicing operation cycle, said water being then accumulated within said water tank.

8. An apparatus according to claim 6, wherein said means includes a water level detecting switch for detecting a predetermined water level within said water tank, wherein a signal outputted from said switch is utilized for changing over said icing operation cycle and said deicing operation cycle to each other.

9. An apparatus according to claim 8, wherein said branch pipe has a second branch pipe branched therefrom at an intermediate portion thereof and connected to a sub-tank communicating hydraulically with said water tank and accommodating therein said water level detecting switch in the form of a float switch.

* * * * *